US010170862B2

(12) United States Patent
Weidner et al.

(10) Patent No.: US 10,170,862 B2
(45) Date of Patent: Jan. 1, 2019

(54) ELECTRICAL DEVICE HAVING A GROUND BUS TERMINATED TO A CABLE DRAIN WIRE

(71) Applicant: TE CONNECTIVITY CORPORATION, Berwyn, PA (US)

(72) Inventors: Kevin Edward Weidner, Hummelstown, PA (US); Tracy Lee Smith, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/491,579

(22) Filed: Apr. 19, 2017

(65) Prior Publication Data

US 2018/0309242 A1 Oct. 25, 2018

(51) Int. Cl.

| | |
|---|---|
| ***H01R 9/05*** | (2006.01) |
| ***H01R 13/6471*** | (2011.01) |
| ***H01R 13/652*** | (2006.01) |
| ***H01R 12/70*** | (2011.01) |
| ***H01R 13/66*** | (2006.01) |
| ***H01R 13/6592*** | (2011.01) |

(52) U.S. Cl.

CPC ..... *H01R 13/6471* (2013.01); *H01R 12/7076* (2013.01); *H01R 13/652* (2013.01); *H01R 13/6592* (2013.01); *H01R 13/665* (2013.01)

(58) Field of Classification Search

CPC ..... H01R 13/6471; H01R 9/05; H01R 24/38
USPC ..... 439/578
See application file for complete search history.

(56) References Cited

U.S. PATENT DOCUMENTS

| | | | | |
|---|---|---|---|---|
| 5,718,607 | A * | 2/1998 | Murphy | H01R 9/038 439/579 |
| 6,210,230 | B1 * | 4/2001 | Lai | H01R 9/0518 439/101 |
| 6,323,430 | B1 * | 11/2001 | Finona | H01R 9/0518 174/135 |
| 6,380,485 | B1 * | 4/2002 | Beaman | H01R 9/035 174/88 R |
| 6,869,308 | B2 | 3/2005 | Wu | |
| 7,906,730 | B2 * | 3/2011 | Atkinson | H01R 13/6592 174/78 |
| 8,011,950 | B2 * | 9/2011 | McGrath | H01R 12/594 439/497 |
| 8,298,009 | B2 * | 10/2012 | Elkhatib | H01R 12/594 439/581 |

(Continued)

*Primary Examiner* — Tulsidas C Patel
*Assistant Examiner* — Peter G Leigh

(57) ABSTRACT

An electrical device includes a circuit board having upper signal contacts and at least one upper ground contact along an upper surface of the circuit board. The electrical device also includes a communication cable including a differential pair of signal conductors, a shield layer that surrounds the signal conductors, a drain wire electrically coupled with the shield layer, and a cable jacket that surrounds the shield layer and the drain wire. Each of the signal conductors has a wire-terminating end engaged to a corresponding signal contact of the circuit board. The wire-terminating ends project beyond a jacket edge of the cable jacket. An upper ground-terminating component electrically couples to the upper ground contact having a main panel with a connective terminal electrically coupled to the drain wire.

20 Claims, 5 Drawing Sheets

(56) References Cited

U.S. PATENT DOCUMENTS

| | | | | |
|---|---|---|---|---|
| 8,337,243 | B2 * | 12/2012 | Elkhatib | H01R 12/594 439/581 |
| 8,475,208 | B2 | 7/2013 | Simpson et al. | |
| 8,632,357 | B2 * | 1/2014 | Straka | H01R 9/034 439/497 |
| 9,124,009 | B2 * | 9/2015 | Atkinson | H01R 13/6464 |
| 9,203,193 | B2 * | 12/2015 | Hackman | H01R 13/648 |
| 9,306,334 | B2 | 4/2016 | Zhu et al. | |
| 9,373,915 | B1 | 6/2016 | Schulz | |
| 9,705,273 | B2 | 7/2017 | Guetig et al. | |
| 9,774,113 | B2 | 9/2017 | Zhang et al. | |
| 2010/0081302 | A1 * | 4/2010 | Atkinson | H01R 13/6474 439/98 |
| 2010/0210142 | A1 * | 8/2010 | McGrath | H01R 12/594 439/620.22 |
| 2011/0306244 | A1 | 12/2011 | Zhang et al. | |
| 2012/0052699 | A1 * | 3/2012 | MacDougall | H01R 9/035 439/55 |
| 2014/0220822 | A1 * | 8/2014 | Keyser | H01R 12/53 439/607.46 |
| 2014/0322966 | A1 * | 10/2014 | Charette | H01R 9/05 439/578 |
| 2017/0040746 | A1 * | 2/2017 | Zhang | H01R 12/594 |

* cited by examiner

ELECTRICAL DEVICE HAVING A GROUND BUS TERMINATED TO A CABLE DRAIN WIRE

BACKGROUND OF THE INVENTION

The subject matter herein relates generally to an electrical device having a circuit board and one or more differential pairs of signal conductors with exposed wire-terminating ends and a drain wire that are terminated to the circuit board.

Various types of electrical devices may include circuit boards that are electrically coupled to differential pairs of signal conductors or, more specifically, pairs of signal conductors that transmit differential signals. For example, at least some known communication cables include a differential pair of signal conductors and a drain wire (also referred to as a grounding wire) that extends alongside the signal conductors for the length of the communication cable. The signal conductor(s) and the drain wire may be surrounded by a shield layer that, in turn, is surrounded by a cable jacket. The shield layer includes a conductive foil that, along with the drain wire, functions to shield the signal conductor(s) from electromagnetic interference (EMI) and generally improve performance. At an end of the communication cable, the cable jacket, the shield layer, and insulation that covers the signal conductor(s) may be removed (e.g., stripped) to expose the signal conductor(s). The drain wire and the exposed portions of the conductor(s) may then be mechanically and electrically coupled (e.g., soldered) to corresponding elements of an electrical device. However, connecting the drain wire can be problematic and result in unreliable connections.

Accordingly, there is a need for an electrical device that provides simple and reliable termination of a cable drain wire to a circuit board.

BRIEF DESCRIPTION OF THE INVENTION

In one embodiment, an electrical device is provided that includes a circuit board having signal contacts and at least one ground contact along a surface of the circuit board. In one embodiment, an electrical device is provided that includes a circuit board having upper signal contacts and at least one upper ground contact along an upper surface of the circuit board. The electrical device includes a communication cable having a differential pair of signal conductors, a shield layer that surrounds the signal conductors, a drain wire electrically coupled with the shield layer, and a cable jacket that surrounds the shield layer and the drain wire. Each of the signal conductors has a wire-terminating end that is engaged to a corresponding upper signal contact of the circuit board, the wire-terminating ends projecting beyond a jacket edge of the cable jacket. The electrical device also includes an upper ground-terminating component electrically coupled to the at least one upper ground contact, the upper ground-terminating component having a main panel with a connective terminal electrically coupled to the drain wire.

In another embodiment, an electrical device is provided having a circuit board having upper signal contacts and at least one upper ground contact along an upper surface of the circuit board. The electrical device includes an upper communication cable including a differential pair of upper signal conductors, an upper shield layer that surrounds the upper signal conductors, an upper drain wire electrically coupled with the upper shield layer, and an upper cable jacket that surrounds the upper shield layer and the upper drain wire.

Each of the upper signal conductors has a wire-terminating end that is engaged to a corresponding upper signal contact of the circuit board. The electrical device also includes an upper ground-terminating component having an upper main panel and an upper finger that projects from the upper main panel, the upper finger engaging the at least one upper ground contact, the upper main panel having a connective terminal that aligns with the upper drain wire, the upper main panel interfacing with the upper drain wire and being electrically coupled to the upper shield layer through the upper drain wire.

In yet another embodiment, an electrical device is provided having a circuit board having signal contacts and ground contacts along a surface of the circuit board. The electrical device also includes a plurality of communication cables that each include a differential pair of signal conductors, a shield layer that surrounds the signal conductors of the respective communication cable, a drain wire electrically coupled with the shield layer, and a cable jacket that surrounds the shield layer and the drain wire of the respective communication cable. Each of the signal conductors has a wire-terminating end that is engaged to a corresponding signal contact of the circuit board. The electrical device also includes a ground-terminating component having a main panel and fingers that project from the main panel, the fingers engaging corresponding ground contacts, the main panel having a plurality of connective terminals electrically coupled to the drain wires of the plurality of communication cables.

DETAILED DESCRIPTION OF THE INVENTION

Embodiments described herein include electrical devices (e.g., electrical connectors, circuit board assemblies, and the like) that have a circuit board and differential pairs of signal conductors and a drain wire terminated to the circuit board. The differential pairs of signal conductors and drain wire may be part of a communication cable (or cables) that also includes a shield layer surrounding the signal conductors and a cable jacket surrounding the shield layer. The cable jacket may have an access opening that exposes a portion of the drain wire so that the drain wire is accessible. For example, embodiments may include a ground-terminating component having a connective terminal that is located proximate to the access opening and is electrically coupled to the drain wire through the access opening. Optionally, a solder material (e.g., metal alloy material) may be deposited within the connective terminal and melted to mechanically and electrically couple the drain wire and the ground-terminating component. Other conductive binding materials (e.g., epoxies, foams, tapes, and the like) may be used to facilitate electrically coupling the drain wire and the ground-terminating component. The ground-terminating component may have a variety of configurations as set forth herein.

Figure 1:
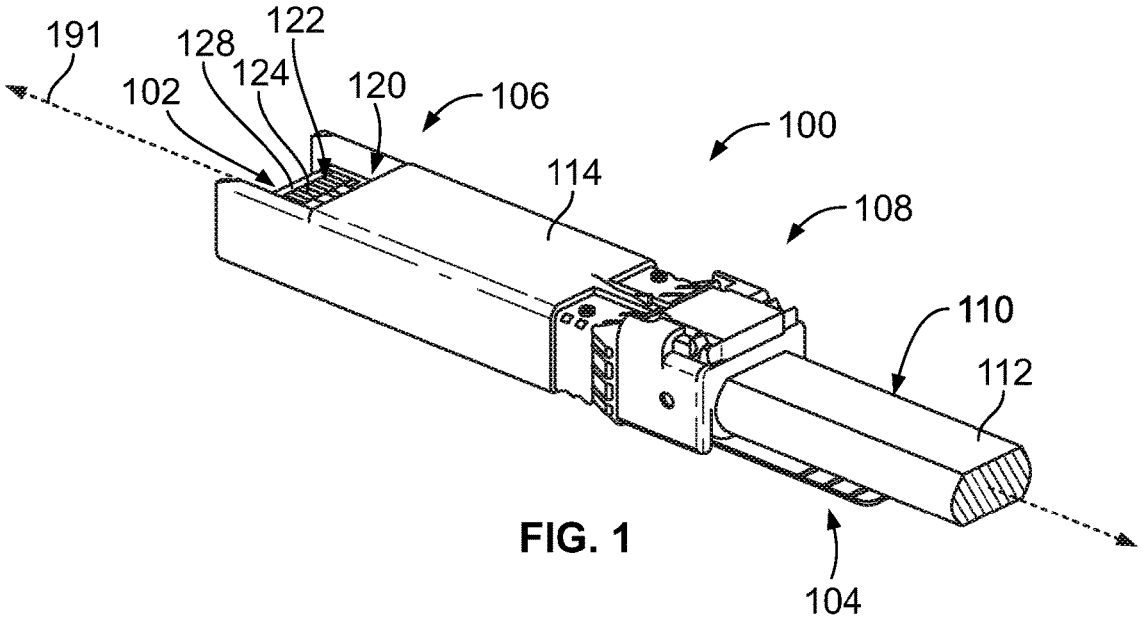
FIG. 1 is a perspective view of an electrical device formed in accordance with an embodiment.

FIG. 1 is a perspective view of an electrical device 100 formed in accordance with one embodiment that includes a circuit board 122 and a communication cable 110 having one or more differential pairs of signal conductors (not shown). In the illustrated embodiment, the electrical device 100 is an electrical connector, such as a small form-factor pluggable (SFP) transceiver. However, the electrical device 100 may be another type of electrical connector in an alternative embodiment. For example, the electrical device 100 may be any device that includes a circuit board having differential pairs of signal conductors and a drain wire terminated thereto.

As shown in FIG. 1, the electrical device 100 has a mating end 102, a loading end 104, and a central axis 191 extending therebetween. The electrical device 100 may include a plug portion 106 at the mating end 102 and a cable portion 108 at the loading end 104. The plug portion 106 is configured to be inserted into a receptacle (not shown) of a communication system (not shown). The cable portion 108 is configured to couple to the communication cable 110 which has an insulative jacket 112. The insulative jacket 112 may surround the one or more differential pairs of signal conductors and the drain wire. The insulative jacket 112 may comprise a number of layers that surround the differential pairs for shielding the differential pairs and providing strain resistance for the communication cables. The layers may include, for example, polyvinyl chloride (PVC), copper braid, aluminized Mylar®, and/or tape.

The electrical device 100 includes a device housing 114 that has a housing cavity (not shown) configured to hold a portion of a connector assembly 120. The connector assembly 120 includes the circuit board 122, which has electrical contacts 124 located at a mating edge 128 of the circuit board 122, which is proximate to the mating end 102 of the electrical device 100. In an exemplary embodiment, the mating edge 128 is configured to mate with an electrical connector (not shown) of the receptacle and establish a communicative connection through the electrical contacts 124. The electrical contacts 124 may be communicatively coupled to the differential pairs of the signal conductors and drain wire.

Figure 2:
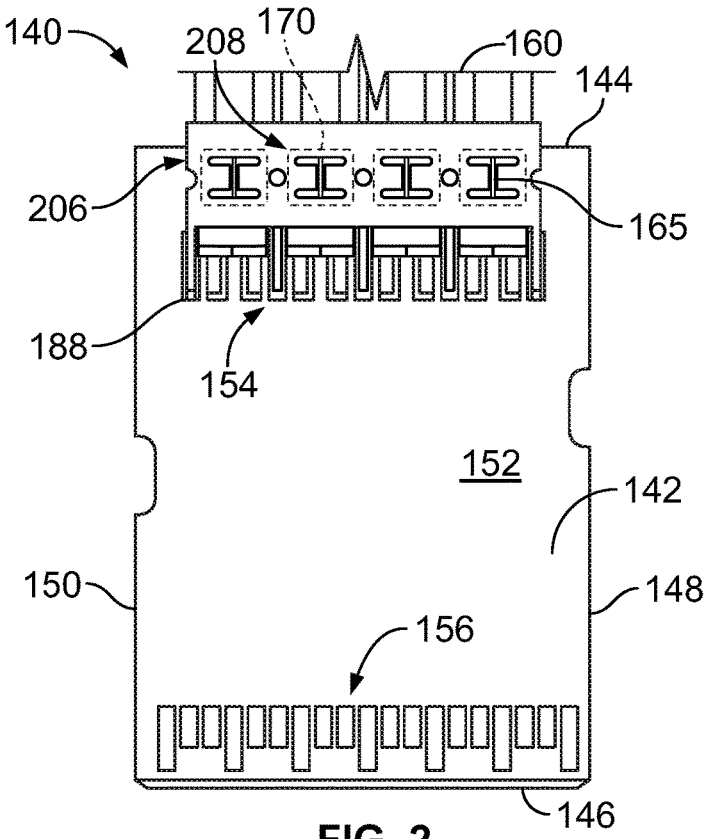
FIG. 2 is a plan view of an electrical assembly according to one embodiment that may be used with the electrical device of FIG. 1.
Figure 3:
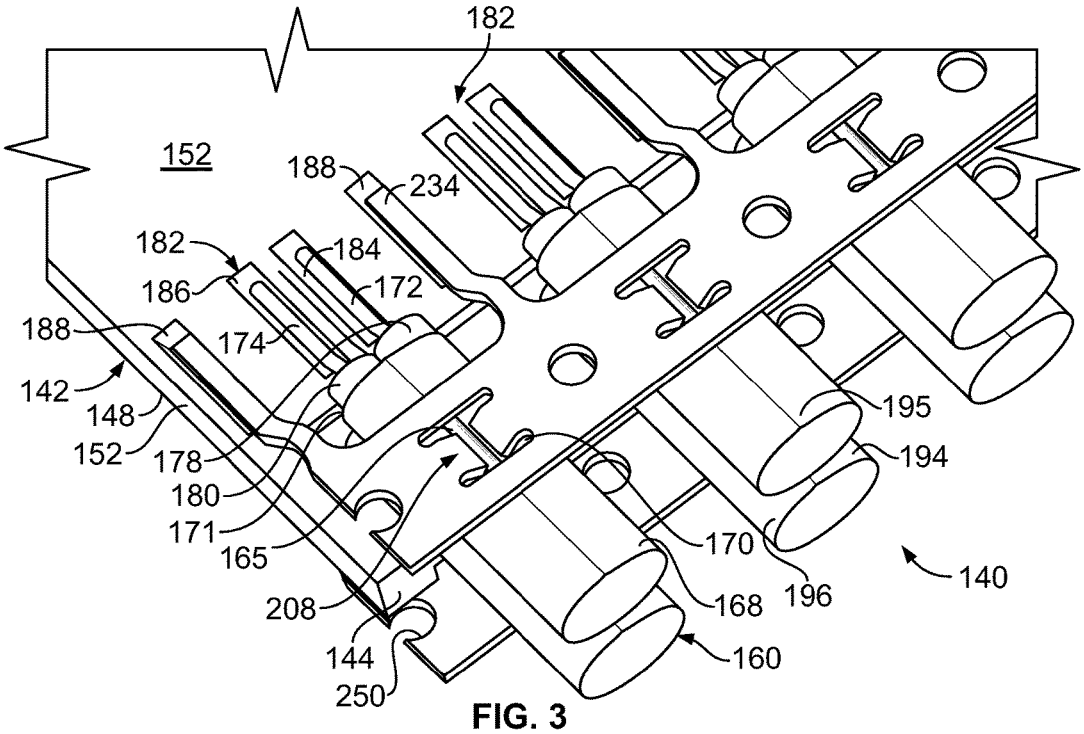
FIG. 3 is an enlarged perspective view of an electrical assembly according to one embodiment that may be used with the electrical device of FIG. 1.

FIG. 2 is a plan view of a portion of an electrical assembly 140 formed in accordance with an embodiment that may be used with the electrical device 100 of FIG. 1. FIG. 3 is an enlarged perspective view of a portion of the electrical assembly 140 formed in accordance with an embodiment that may be used with the electrical device 100. The electrical assembly 140 may be used as the connector assembly 120 (FIG. 1) and may be disposed at least partially within the device housing 114 (FIG. 1). The electrical assembly 140 includes a circuit board 142 having a terminating edge 144, a mating edge 146, and side edges 148, 150 that extend from the terminating edge 144 toward the mating edge 146. Although not shown, the circuit board 142 may include a number of dielectric layers (e.g., FR-4 layers), traces, vias, and ground planes.

The circuit board 142 includes upper and lower board surfaces 152 that face in opposite directions. As shown, the board surfaces 152 include upper and lower electrical contacts 154 that are proximate to the terminating edge 144 and upper and lower electrical contacts 156 that are proximate to the mating edge 146. In the illustrated embodiment, the electrical contacts 154, 156 are contact pads and may include signal and ground contacts. The electrical contacts 154, 156 may be communicatively coupled to one another through the circuit board 142. For example, the traces (not shown) of the circuit board 142 may communicatively couple the electrical contacts 154, 156.

The electrical assembly 140 also includes a plurality of communication cables 160 that are electrically coupled to the circuit board 142 along the board surfaces 152. Four communication cables 160 are shown terminated to the upper board surface and four communication cables 160 are shown terminated to the lower board surface of the circuit board 142.

In some embodiments, the communication cables 160 may be characterized as twin-axial or parallel-pair cables that includes a drain wire 165. In parallel-pair configurations, the communication cables 160 include differential pairs of signal conductors in which the two signal conductors of a single differential pair extend parallel to each other through a length of the communication cable 160. The drain wire 165 also extends parallel with the signal conductors through the length of the communication cable 160. Although not shown, the communication cables 160 of FIG. 2 may be part of a larger cable and may be surrounded by an external jacket or sleeve. The external jacket may be stripped to permit manipulation of the communication cables 160 as set forth herein. In alternative embodiments, the signal conductors within the communication cable 160 may form a twisted pair of signal conductors. In other various embodiments, the communication cable 160 may be a single-ended cable having a single central conductor rather than the pair of signal conductors.

The electrical assembly 140 includes upper and lower ground-terminating components 206 that electrically couple to the circuit board 142 and the communication cables 160. Each ground-terminating component 206 may be a single continuous piece of material. For example, the ground-terminating component 206 may be stamped and formed from sheet metal or may be molded or cast using a conductive material. As set forth in greater detail below, embodiments may include ground-terminating components that are configured to ground the communication cables to the circuit board. Although two ground-terminating components are shown in FIG. 3, alternate embodiments of the electrical assembly may include only more or fewer ground-terminating components 206.

Figure 4:
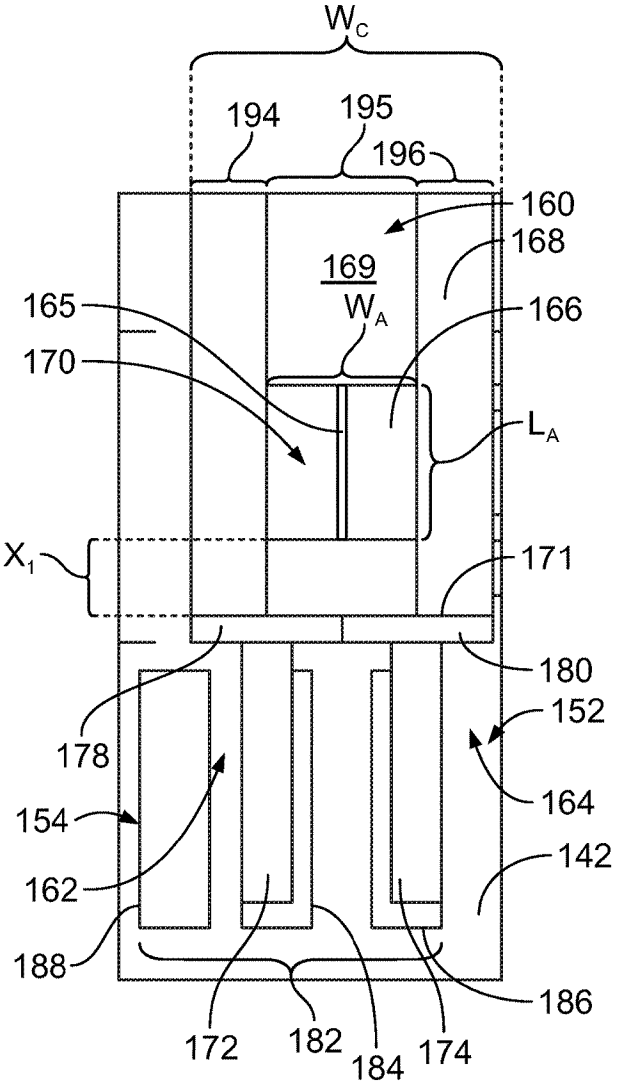
FIG. 4 is an enlarged portion of the plan view of FIG. 1 illustrating features of the electrical assembly in greater detail.

FIG. 4 is an enlarged view of one of the communication cables 160 coupled to the circuit board 142 along the board surface 152. The ground-terminating component is not shown in FIG. 4 to better illustrate the communication cables 160. Each of the communication cables 160 may include a differential pair of signal conductors 162, 164, a shield layer 166 that surrounds the signal conductors 162, 164, the drain wire 165 and a cable jacket 168 that surrounds the drain wire 165 and the shield layer 166. By way of example only, the cable jacket 168 may be formed from a polyester-like material, such as biaxially-oriented polyethylene terephthalate (BoPET), which is also known as Mylar®. For parallel-pair configurations, the communication cable 160 has opposite contoured sides 194, 196 and opposite planar sides 195 that extend between and join the contoured sides 194, 196. Only one planar side 195 is shown in FIG. 4, but it is understood that the communication cable 160 has another planar side 195 that is opposite the planar side 195 as shown in FIG. 3. The contoured sides 194, 196 may have cross-sections taken transverse to a length of the communication cable 160 that have a semi-circle shape. The communication cable 160 has a width $W_C$.

The shield layer 166 may include, for example, a conductive foil (e.g., copper). As shown, the shield layer 166 is exposed through an access opening 170 of the cable jacket 168. The access opening 170 may be spaced from an end of the cable jacket 168. For example, the cable jacket 168 includes a jacket edge 171. The access opening 170 may be located a longitudinal distance $X_1$ away from the jacket edge 171 along a length of the communication cable 160.

The access opening 170 extends a depth into the communication cable 160 from an exterior surface 169 of the cable jacket 168 to the shield layer 166. The access opening 170 may be formed by, for example, using a laser (e.g., $CO_2$ laser) to etch the cable jacket 168 to remove the material of the cable jacket 168 and expose the shield layer 166 and drain wire 165. Accordingly, the access opening 170 may be a void along the shield layer 166 and drain wire 165. The access opening 170 may be partially defined by the material of the cable jacket 168 and the shield layer 166 (e.g., conductive foil). The access opening 170 may open to an exterior of the communication cable 160.

The access opening 170 may have a width $W_A$ and a length $L_A$. In the illustrated embodiment, the width $W_A$ is less than the width $W_C$ of the communication cable 160. The width $W_A$ may be sized such that the access opening 170 extends only along the planar side 195 and does not extend into the contoured sides 194, 196. However, the width $W_A$ may be larger in other embodiments such that portions of the contoured sides 194, 196 also have material from the cable jacket 168 removed. For example, the width $W_A$ may be substantially equal to the width $W_C$.

In an exemplary embodiment, the signal conductors 162, 164 are insulated conductors having insulation layers 178, 180, respectively, that surround corresponding wire conductors 172, 174. As shown in FIG. 3-4, the wire conductors 172, 174 have had the insulation layers 178, 180 stripped therefrom to expose the wire conductors 172, 174. The exposed portions of the wire conductors 172, 174 are configured to be terminated to the circuit board 142. As such, the exposed portions of the wire conductors 172, 174 are hereinafter referred to as a wire-terminating ends 172, 174.

The communication cable 160 is configured to electrically couple to the circuit board 142 at multiple points. To this end, the circuit board 142 includes a contact set 182 that has three of the electrical contacts 154. More specifically, the contact set 182 includes a pair of signal contacts 184, 186 and a ground contact 188 that is located proximate to the pair of signal contacts 184, 186. In some cases, another ground contact may be positioned on an opposite side of the pair of signal contacts 184, 186. The circuit board 142 may have multiple contact sets 182 in which each contact set 182 electrically couples to a single communication cable 160. The signal contacts 184, 186 are configured to be electrically coupled to the wire-terminating ends 172, 174, respectively. For example, the wire-terminating ends 172, 174 may be soldered to the signal contacts 184, 186, respectively.

Referring again to FIGS. 2-3, the ground-terminating components 206 extend between the access openings 170 and the ground contacts 188. The ground-terminating components 206 may be mechanically and electrically coupled to the drain wires 165 by connective terminals 208 that extend through the access openings 170, and the ground terminating components 206 may be mechanically and electrically coupled to the ground contacts 188. The mechanical and electrical coupling may be accomplished through soldering and/or using a conductive epoxy or foam. As such, each communication cable 160 may be grounded to the circuit board 142 by establishing a conductive path between the shield layer 166, the drain wire 165, and the ground contact 188. The ground contact 188, in turn, may be electrically coupled to one or more ground planes (not shown) of the circuit board 142.

Figure 5:
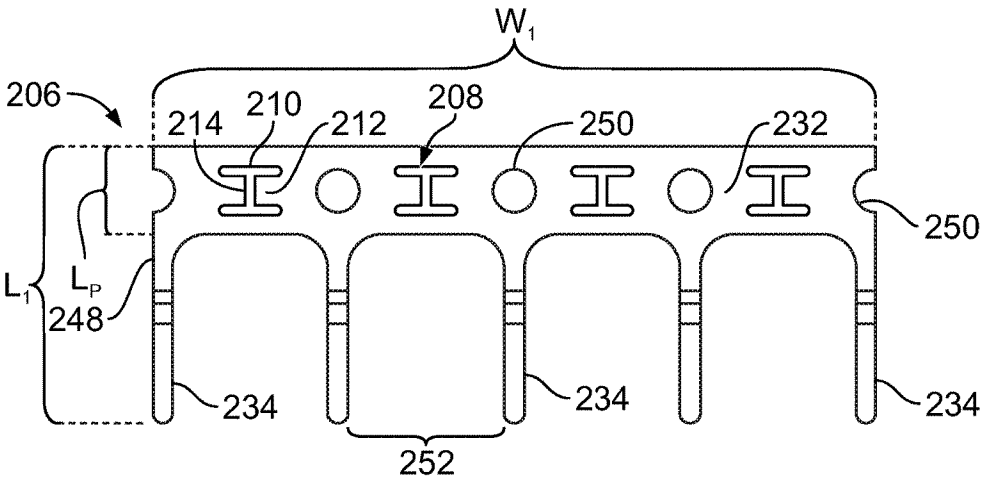
FIG. 5 is a plan view of a ground-terminating component that may be used with the electrical assembly of FIG. 2.
Figure 6:
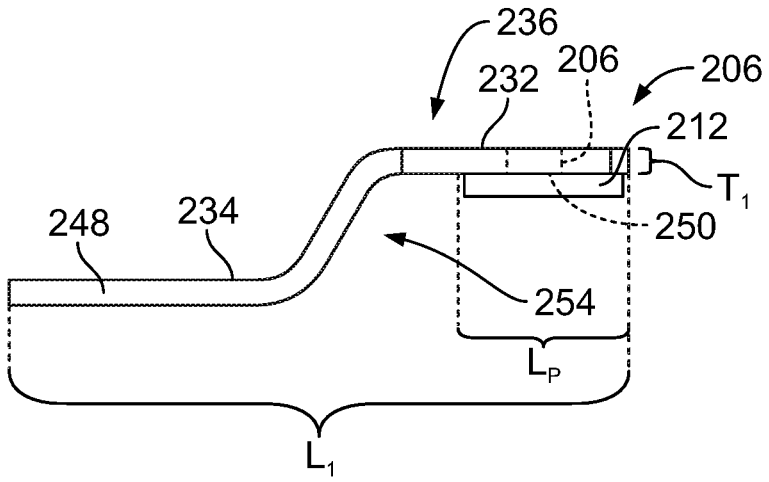
FIG. 6 is a side view of the ground-terminating component that may be used with the electrical assembly of FIG. 2.

FIGS. 5 and 6 are isolated plan and side views of the ground-terminating component 206 in accordance with one embodiment. As shown, the ground-terminating component 206 includes a main panel or busbar portion 232 and a plurality of fingers 234 that extend therefrom. The fingers 234 are configured to be mechanically and electrically coupled to corresponding ground contacts 188 of the circuit board 142 (FIG. 3). In some embodiments, the ground-terminating component 206 is stamped from sheet metal and formed to include the features set forth herein. The ground-terminating component 206 has a length $L_1$ (FIG. 5), a width $W_1$ (FIG. 5), and a thickness $T_1$ (FIG. 6). The main panel 232 has a length $L_P$. The ground-terminating component 206 includes a top surface 236 and a bottom surface 238 (FIG. 6) that face in opposite directions. The thickness $T_1$ is measured between the top and bottom surfaces 236, 238. In the illustrated embodiment, the thickness $T_1$ is substantially uniform, but may have varying sizes in other embodiments. As shown on FIG. 3, the main panel 232 may be positioned adjacent to the communication cables 160 such that the bottom surface 238 (FIG. 6) along the main panel 232 interfaces with the cable jackets 168 and/or covers the access opening 170.

A profile of the ground-terminating component 206 is defined by a wall edge 248, which is a stamped edge in the illustrated embodiment. As shown, the wall edge 248 defines the main panel 232 and the fingers 234. The main panel 232 has a substantially rectangular shape with the fingers 234 extending therefrom. The fingers 234 are distributed along the width $W_1$ of the ground-terminating component 206. Adjacent fingers 234 may be separated from each other by a pair spacing 252 (FIG. 5). The pair spacing 252 may be sized so that a differential pair of signal conductors may be positioned between the adjacent fingers 234.

As shown in FIG. 6, the fingers 234 may include joint portions 254. The joint portions 254 are configured to change a level of the bottom surface 238. More specifically, a portion of the bottom surface 238 associated with the main panel 232 is configured to interface with the communication cables 160 (FIG. 3) at a first level and a portion of the bottom surface 238 associated with the fingers 234 is configured to interface with the circuit board 142 at a different second level. In this way, the fingers 234 are non-planar with the main panel 232 so that the fingers 234 are positioned for alignment with the ground contacts 188 of the circuit board 142 and the connective terminals 208 are positioned for alignment with the drain wires 165. The joint portions 254 shown in FIG. 6 are positioned at an angle of about 45° relative to the main panel 232 and/or the fingers 234. However, in other embodiments the joint portions can be positioned at any angle greater than 0°. In addition, the joint portions 254 can embody any non-linear shape, such as curved, that positions the main panel 232 and the fingers 234 at respective different levels or planes.

The main panel 232 includes a plurality of the connective terminals 208 that are aligned with corresponding access openings 170 of the cable jackets 168. Each connective terminal 208 includes a substantially rectangular opening 210 with a pair of opposed tabs 212 extending inwardly towards each other. The tabs 212 angle downwardly at an angle of about 30-45° (FIG. 3) from the plane of the main body portion 232 to form a channel 214 between the tabs 212. The channel 214 is configured to receive the drain wire 165 of a communication cable 160 and to provide an opening for application of solder or other conductive binding material. Alternatively, the tabs 212 can be positioned at any angle for alignment of the channel 214 with the drain wire 165. For example, in an alternate embodiment shown in FIG. 9, which will be discussed in greater detail below, the tabs can be angled upwardly.

In other embodiments, the connective terminals 208 may have other configurations to mechanically and electrically couple the ground-terminating component 206 with the drain wires 165, including, but not limited to, a single tab, or an insulation displacement connector. In addition, the connective terminal can be configured to couple with the drain wire 165 with an interference or pinch fit.

For embodiments that include the access openings 170, the connective terminals 208 of the main panel 232 may be located to align with corresponding access openings 170 of the cable jackets 168 when the main panel 232 interfaces with the communication cable 160. The tabs 212 extend a depth into the access openings 170 so that the drain wire 165 aligns within the channel 214. Solder paste (not shown) may be deposited into and/or near the access openings 170 and the connective terminals 208. Heat may be applied to the electrical assembly 140 to melt and/or cure the solder paste. After the heating stage, the solder mechanically and electrically couples the main panel 232 to the drain wires 165 of the different communication cables 160.

In other embodiments, a different conductive binding material may be used. For example, the conductive binding material may be an adhesive, epoxy, foam, tape, or the like. The conductive binding material may or may not affix the main panel 232 to the drain wire 165. In some embodiments, a conductive tape or other binding material may be deposited directly along the bottom surface 238. The bottom surface 238 may then be pressed against the drain wire 165. The action of compressing the binding material may activate the binding material to harden or cure. For such embodiments, a wall opening may or may not be used.

In certain embodiments, the main panel 232 includes a plurality of wall openings 250 available for mechanically and electrically coupling with other electrical components. The wall openings 250 can extend entirely through the thickness $T_1$. In other embodiments, the wall openings 250 may extend only partially through the thickness $T_1$ or, alternatively, the main panel 232 may not include the wall openings 250. The wall openings 250 may be dimensioned to permit a solder paste to be deposited therethrough. In other embodiments, a conductive epoxy or foam may be deposited through the wall openings 250.

Figure 7:
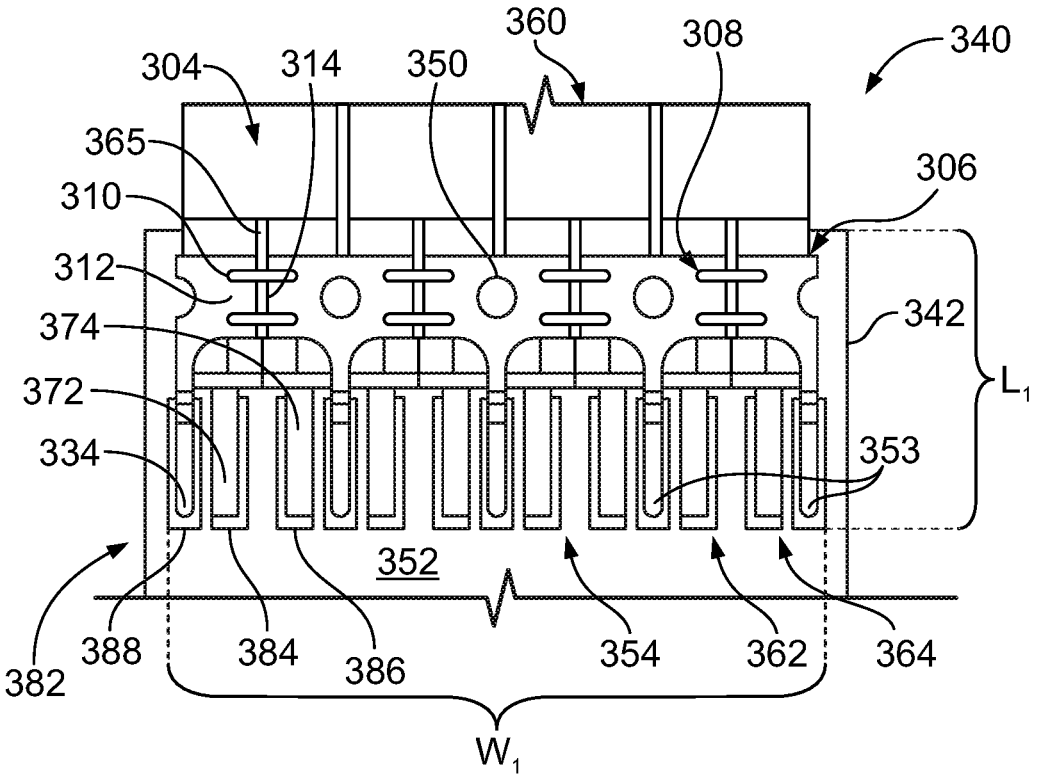
FIG. 7 is an enlarged plan view of an electrical assembly according to one embodiment that may be used with the electrical device of FIG. 1.
Figure 8:
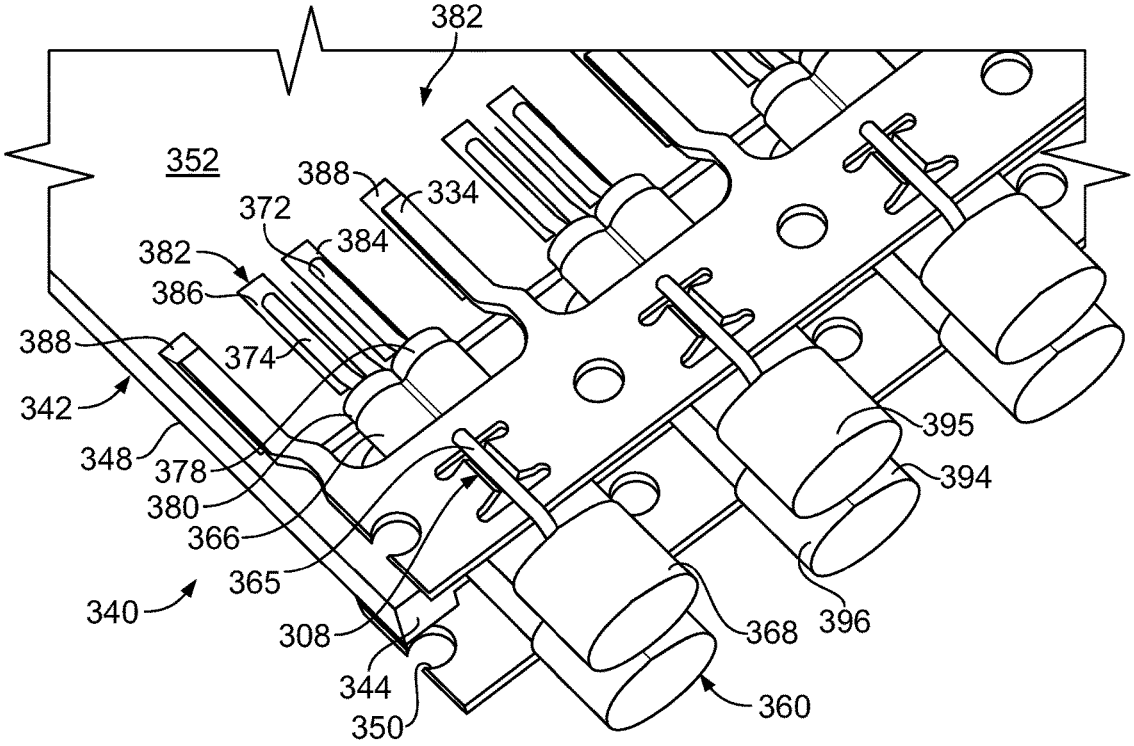
FIG. 8 is an enlarged perspective view of an electrical assembly according to one embodiment that may be used with the electrical device of FIG. 1.

FIG. 7 is an enlarged plan view of an electrical assembly 340 according to one embodiment that may be used with the electrical device 100 of FIG. 1. FIG. 8 is an enlarged perspective view of a portion of an electrical assembly 340 formed in accordance with an embodiment that may be used with the electrical device 100. The electrical assembly 340 includes a circuit board 342, communication cables 360, and ground-terminating components 306 that electrically couple the circuit board 342 and the communication cables 360. The components 306 may be similar or identical to the components in FIG. 2. However, the embodiment of FIG. 7 does not include access openings 170. In addition, tabs 312 of connective terminals 308 are angled upwardly instead of downwardly (FIG. 6) for alignment with drain wires 365.

For example, the circuit board 342 includes upper and lower board surfaces 352 that face in opposite directions, although only one board surface is shown in FIG. 7. As shown, the board surfaces 352 include upper and lower electrical contacts 354 that are proximate to the terminating edge 344 and upper and lower electrical contacts that are proximate to the mating edge (not shown). In the illustrated embodiment, the electrical contacts 354 are contact pads and may include signal and ground contacts. The electrical contacts 354 may be communicatively coupled to one another through the circuit board 342. For example, the traces (not shown) of the circuit board 342 may communicatively couple the electrical contacts 354.

The communication cables 360 are electrically coupled to the circuit board 342 along the board surfaces 352. Four communication cables 360 are shown terminated to the upper board surface 352 and four communication cables 360 are shown terminated to the lower board surface 352. In various embodiments, the communication cables 360 are twin-axial or parallel-pair cables that include drain wires 365. Although not shown, the communication cables 360 may be part of a larger cable and may be surrounded by an external jacket or sleeve. The external jacket may be stripped to permit manipulation of the communication cables 360 as set forth herein. In alternative embodiments, the signal conductors within the communication cable 360 may form a twisted pair of signal conductors.

The electrical assembly 340 includes upper and lower ground-terminating components 306 that electrically couple to the circuit board 342 and the communication cables 360. Each ground-terminating component 306 may be a single continuous piece of material. For example, the ground-terminating component 306 may be stamped and formed from sheet metal or may be molded or cast using a conductive material. As set forth in greater detail below, embodiments may include ground-terminating components that are configured to ground the communication cables to the circuit board.

Each of the communication cables 360 may include a differential pair of signal conductors 362, 364, a shield layer 366 that surrounds the signal conductors 362, 364, the drain wire 365, and a cable jacket 368 that surrounds the drain wire 365 and the shield layer 366. In the illustrated embodiment, the communication cable 360 has opposite contoured sides 394, 396 and opposite planar sides 395 that extend between and join the contoured sides 394, 396.

In an exemplary embodiment, the signal conductors 362, 364 are insulated conductors having insulation layers 378, 380, respectively, that surround corresponding wire conductors 372, 374. As shown in FIG. 7-8, the wire conductors 372, 374 have had the insulation layers 378, 380 stripped therefrom to expose the wire conductors 372, 374. The exposed portions of the wire conductors 372, 374 are configured to be terminated to the circuit board 342. As such, the exposed portions of the wire conductors 372, 374 are hereinafter referred to as wire-terminating ends 372, 374.

As shown in FIG. 7-8, the shield layer 366 has had the cable jacket 368 stripped therefrom to expose the shield layer 366 and the drain wire 365. The exposed portions of the shield layer 366 and the drain wire 365 are configured to be terminated to the ground-terminating component 306.

The communication cable 360 is configured to electrically couple to the circuit board 342 at multiple points. To this end, the circuit board 342 includes contact sets 382 that have three of the electrical contacts 354. More specifically, each contact set 382 includes a pair of signal contacts 384, 386 and a ground contact 388 that is located proximate to the pair of signal contacts 384, 386. In some cases, another ground contact 388 may be positioned on an opposite side of the pair of signal contacts 384, 386. The circuit board 342 may have multiple contact sets 382 in which each contact set 382 electrically couples to a single communication cable 360. The signal contacts 384, 386 are configured to be electrically coupled to the wire-terminating ends 372, 374, respectively. For example, the wire-terminating ends 372, 374 may be soldered to the signal contacts 384, 386, respectively.

The ground-terminating components 306 interconnect the drain wires 365 and the ground contacts 388. The ground-terminating components 306 may be mechanically and electrically coupled to the drain wires 365 by connective terminals 308, and may be mechanically and electrically coupled to the ground contacts 388. The mechanical and electrical coupling may be accomplished through soldering and/or using a conductive epoxy or foam. As such, each communication cable 360 may be grounded to the circuit board 342 by establishing a conductive path between the shield layer 366, the drain wire 365, and the ground contact 388. The ground contact 388, in turn, may be electrically coupled to one or more ground planes (not shown) of the circuit board 342.

Figure 9:
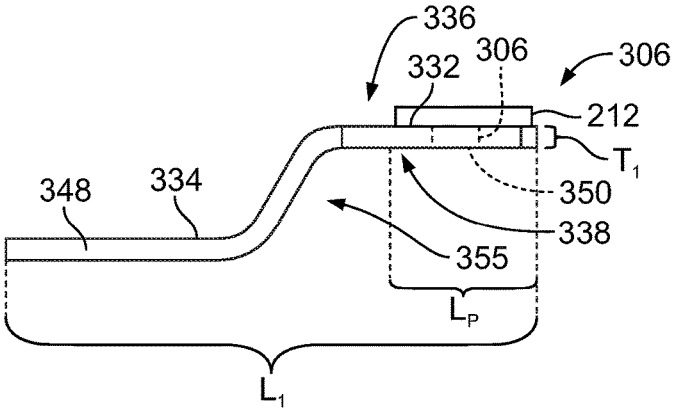
FIG. 9 is a side view of the ground-terminating component that may be used with the electrical assembly of FIG. 8.

FIG. 9 is an isolated side view of the ground-terminating component 306 in accordance with one embodiment. As shown, the ground-terminating component 306 includes a main panel or busbar portion 332 and a plurality of fingers 334 that extend therefrom. The fingers 334 are configured to be mechanically and electrically coupled to corresponding ground contacts 388 of the circuit board 342. In some embodiments, the ground-terminating component 306 is stamped from sheet metal and formed to include the features set forth herein. The ground-terminating component 306 has a length $L_1$ (FIG. 7), a width $W_1$, and thickness $T_1$ (FIG. 9). The main panel 332 has a length $L_P$. The ground-terminating component 306 includes a top surface 336 and a bottom surface 338 that face in opposite directions. The thickness $T_1$ is measured between the top and bottom surfaces 336, 338. In the illustrated embodiment, the thickness $T_1$ is substantially uniform, but may have varying sizes in other embodiments. The main panel 332 may be positioned adjacent to the communication cables 360 such that the bottom surface 338 along the main panel 332 interfaces with the cable jackets 368.

A profile of the ground-terminating component 306 is defined by a wall edge 348, which is a stamped edge in the illustrated embodiment (FIG. 9). As shown, the wall edge 348 defines the main panel 332 and the fingers 334. The main panel 332 has a substantially rectangular shape with the fingers 334 extending therefrom. The fingers 334 are distributed along the width $W_1$ of the ground-terminating component 306. Adjacent fingers 334 may be separated from each other by a pair spacing 353 (FIG. 7). The pair spacing 353 may be sized so that a differential pair of signal conductors may be positioned between the adjacent fingers 334.

As shown in FIG. 9, the fingers 334 may include joint portions 355. The joint portions 355 are configured to change a level of the bottom surface 338. More specifically, a portion of the bottom surface 338 associated with the main panel 332 is configured to interface with the communication cables 360 (FIG. 8) at a first level and a portion of the bottom surface associated with the fingers 334 is configured to interface with the circuit board 342 (FIG. 8) at a different second level. In this way, the fingers 334 are non-planar with the main panel 332 so that the fingers 334 are positioned for alignment with the ground contacts 388 of the circuit board 342 and the connective terminals 308 are positioned for alignment with the drain wires 365. The joint portions 355 shown in FIG. 9 are positioned at an angle of about 45° relative to the main panel 332 and/or the fingers 334. However, in other embodiments the joint portions can be positioned at any angle greater than 0°. In addition, the joint portions 355 can embody any non-linear shape, such as curved, that positions the main panel 332 and the fingers 334 at respective different levels or planes.

With additional reference to FIGS. 7 and 8, the main panel 332 includes the connective terminals 308 that are aligned with corresponding drain wires 365. Each connective terminal 308 includes a substantially rectangular opening 310 with a pair of opposed tabs 312 extending inwardly towards each other. The tabs 312 angle upwardly at an angle of about 30-45° from the main panel 332 to form a channel 314 between the tabs 312. The channel 314 is configured to align with the drain wire 365 of a corresponding communication cable 360. Alternatively, the tabs 312 can be positioned at any angle for alignment of the channel 314 with the drain wire 365.

In other embodiments, the connective terminals 308 may embody other configurations to mechanically and electrically couple the ground-terminating component 306 with the drain wire 365, including, but not limited to, a single tab, or an insulation displacement connector. In addition, the connective terminal can be configured to couple with the drain wire 365 with an interference or pinch fit.

Solder paste (not shown) may be deposited into and/or near the connective terminals 308. Heat may be applied to the electrical assembly 340 to melt and/or cure the solder paste. After the heating stage, the solder mechanically and electrically couples the main panel 332 to the drain wires 365 of the different communication cables 360.

In other embodiments, a different conductive binding material may be used. For example, the conductive binding material may be an adhesive, epoxy, foam, tape, or the like. The conductive binding material may or may not affix the main panel 332 to the drain wires 365. In some embodiments, a conductive tape or other binding material may be deposited directly along the upper surface of the main panel 332. The upper surface may then be pressed against the drain wires 365. The action of compressing the binding material may activate the binding material to harden or cure. For such embodiments, a wall opening may or may not be used.

In certain embodiments, the main panel 332 includes a plurality of wall openings 350 available for mechanically and electrically coupling with other electrical components. The wall openings 350 can extend entirely through the thickness $T_1$. In other embodiments, the wall openings 350 may extend only partially through the thickness $T_1$ or, alternatively, the main panel 332 may not include the wall openings 350. The wall openings 350 may be dimensioned to permit a solder paste to be deposited therethrough. In other embodiments, a conductive epoxy or foam may be deposited through the wall openings 350.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical device comprising:

a circuit board having upper signal contacts and at least one upper ground contact along an upper surface of the circuit board;

a communication cable including a differential pair of signal conductors, a shield layer that surrounds the signal conductors, a drain wire electrically coupled with the shield layer, and a cable jacket that surrounds the shield layer and the drain wire; wherein each of the signal conductors has a wire-terminating end that is engaged to a corresponding upper signal contact of the circuit board, the wire-terminating ends projecting beyond a jacket edge of the cable jacket; and an upper ground-terminating component electrically coupled to the at least one upper ground contact, the upper ground-terminating component having a main panel with a connective terminal electrically coupled to the drain wire, the connective terminal including an opening and a pair of opposed angled tabs, wherein each of the opposed angled tabs includes a base end and a free end, the free end of each of the opposed angled tabs extending into the opening and away from the main panel.

2. The electrical device of claim 1, wherein the drain wire projects beyond the jacket edge of the cable jacket, wherein the drain wire is aligned with the connective terminal.

3. The electrical device of claim 1, wherein, the cable jacket having an access opening being located a longitudinal distance from the jacket edge of the cable jacket.

4. The electrical device of claim 3, wherein the upper ground-terminating component has a finger that projects from the main panel, the finger engaging the at least one upper ground contact, the main panel interfacing with the cable jacket and being electrically coupled to the drain wire through the access opening.

5. The electrical device of claim 4, wherein the main panel is positioned at a first level with the connective terminal in alignment with the drain wire, and the finger is positioned at a second level in alignment with the upper ground contact.

6. The electrical device of claim 1, wherein the connective terminal includes the pair of opposed angled tabs defining a channel therebetween for alignment with a portion of the drain wire.

7. The electrical device of claim 1, further comprising a conductive binding material located within the connective terminal that electrically couples the upper ground-terminating component to the drain wire.

8. The electrical device of claim 1, further comprising lower signal contacts and at least one lower ground contact along a lower surface of the circuit board;

a second communication cable including a differential pair of signal conductors, a shield layer that surrounds the signal conductors, a drain wire electrically coupled with the shield layer, and a cable jacket that surrounds the shield layer and the drain wire; wherein each of the signal conductors has a wire-terminating end that is engaged to a corresponding lower signal contact of the circuit board, the wire-terminating ends projecting beyond a jacket edge of the cable jacket; and a lower ground-terminating component electrically coupled to the at least one lower ground contact, the lower ground-terminating component having a main panel with a connective terminal electrically coupled to the drain wire, the connective terminal having an opening and a pair of opposed angled tabs, wherein each of the opposed angled tabs includes a base end and a free end, the free end of each of the opposed angled tabs extending into the opening and away from the main panel.

9. An electrical device, comprising:

a circuit board having upper signal contacts and at least one upper ground contact along an upper surface of the circuit board;

an upper communication cable including a differential pair of upper signal conductors, an upper shield layer that surrounds the upper signal conductors, an upper drain wire electrically coupled with the upper shield layer, and an upper cable jacket that surrounds the upper shield layer and the upper drain wire; wherein each of the upper signal conductors has a wire-terminating end that is engaged to a corresponding upper signal contact of the circuit board; and an upper ground-terminating component having an upper main panel and an upper finger that projects from the upper main panel, the upper finger engaging the at least one ground contact, the upper main panel having an upper connective terminal that aligns with the upper drain wire, the upper connective terminal having an opening and at least one angled tab, wherein the at least one angled tab includes a base end and a free end, the free end of the at least one angled tab extending into the opening and away from the upper main panel, the free end of the at least one angled tab of the upper main panel interfacing with the upper drain wire and being electrically coupled to the upper shield layer through the upper drain wire.

10. The electrical device of claim 9, wherein the upper main panel is positioned at a first level with the upper connective terminal in alignment with the upper drain wire, and the upper finger is positioned at a second level in alignment with the upper ground contact.

11. The electrical device of claim 9, the upper cable jacket having an access opening being located a longitudinal distance from the jacket edge of the upper cable jacket, the opening exposing a portion of the upper drain wire.

12. The electrical device of claim 9, further comprising:

lower signal contacts and at least one lower ground contact along a lower surface of the circuit board;

a lower communication cable including a differential pair of lower signal conductors, a lower shield layer that surrounds the lower signal conductors, a lower drain wire electrically coupled with the lower shield layer, and a lower cable jacket that surrounds the lower shield layer and the lower drain wire; wherein each of the lower signal conductors has a wire-terminating end that is engaged to a corresponding lower signal contact of the circuit board; and a lower ground-terminating component having a lower main panel and a lower finger that projects from the lower main panel, the lower finger engaging the at least one lower ground contact, the lower main panel having a lower connective terminal that aligns with the lower drain wire, the lower connective terminal having an opening and at least one angled tab, wherein the at least one angled tab includes a base end and a free end, the free end of the at least one angled tab extending into the opening and away from the lower main panel, the free end of the at least one angled tab of the lower main panel interfacing with the lower drain wire and being electrically coupled to the lower shield layer through the lower drain wire.

13. The electrical device of claim 9, wherein the upper connective terminal includes the at least one angled tab defining a channel for alignment with a portion of the upper drain wire.

14. The electrical device of claim 9, further comprising a conductive binding material located within the upper connective terminal that electrically couples the upper ground-terminating component to the upper drain wire.

15. The electrical device of claim 9, further comprising a plurality of the upper communication cables and a plurality of the upper ground-terminating components, each of the upper connective terminals of the upper ground-terminating components aligning with a respective upper drain wire of the plurality of the upper communication cables.

16. The electrical device of claim 9, wherein the upper connective terminal is an insulation displacement connector.

17. An electrical device, comprising:

a circuit board having signal contacts and ground contacts along a surface of the circuit board;

a plurality of communication cables that each include a differential pair of signal conductors, a shield layer that surrounds the signal conductors of the respective communication cable, a drain wire electrically coupled with the shield layer, and a cable jacket that surrounds the shield layer and the drain wire of the respective communication cable; wherein each of the signal conductors has a wire-terminating end that is engaged to a corresponding signal contact of the circuit board;

a ground-terminating component having a main panel and fingers that project from the main panel, the fingers engaging corresponding ground contacts, the main panel having a plurality of connective terminals electrically coupled to the drain wires of the communication cables, each of the connective terminals having an opening and at least one angled tab, wherein the at least one angled tab includes a base end and a free end, the free end of the at least one angled tab extending into the opening and away from the main panel.

18. The electrical device of claim 17, wherein the main panel is positioned at a first level with the connective terminal in alignment with the drain wire, and the fingers are positioned at a second level in alignment with the ground contacts.

19. The electrical device of claim 17, the cable jacket having an access opening being located a longitudinal distance from the jacket edge of the cable jacket, the opening exposing a portion of the drain wire.

20. The electrical device of claim 17, further comprising conductive binding material located within the connective terminals, the conductive binding material electrically coupling the ground-terminating component to the drain wires of the communication cables.

* * * * *